US011950633B2

(12) United States Patent
Hejazi

(10) Patent No.: US 11,950,633 B2
(45) Date of Patent: Apr. 9, 2024

(54) ATOMIZER AND AEROSOL DELIVERY DEVICE

(71) Applicant: RAI Strategic Holdings, Inc., Winston-Salem, NC (US)

(72) Inventor: Vahid Hejazi, Concord, NC (US)

(73) Assignee: RAI Strategic Holdings, Inc., Winston-Salem, NC (US)

( * ) Notice: Subject to any disclaimer, the term of this patent is extended or adjusted under 35 U.S.C. 154(b) by 643 days.

(21) Appl. No.: 17/161,039

(22) Filed: Jan. 28, 2021

(65) Prior Publication Data

US 2021/0145064 A1 May 20, 2021

Related U.S. Application Data

(63) Continuation of application No. 15/980,816, filed on May 16, 2018, now Pat. No. 10,932,490.

(51) Int. Cl.

| | |
|---|---|
| ***A24F 40/48*** | (2020.01) |
| ***A24F 40/44*** | (2020.01) |
| ***A24F 40/46*** | (2020.01) |
| ***A24F 40/485*** | (2020.01) |
| *A24F 40/10* | (2020.01) |

(52) U.S. Cl.

CPC ..... *A24F 40/485* (2020.01); *A24F 40/44* (2020.01); *A24F 40/46* (2020.01); *A24F 40/10* (2020.01)

(58) Field of Classification Search

CPC ..... A24F 40/44; A24F 40/46; A24F 40/485

See application file for complete search history.

(56) References Cited

U.S. PATENT DOCUMENTS

| | | | |
|---|---|---|---|
| 2,057,353 | A | 10/1936 | Whittemore, Jr. |
| 2,104,266 | A | 1/1938 | McCormick |
| 3,200,819 | A | 8/1965 | Gilbert |
| 4,922,901 | A | 5/1990 | Brooks et al. |
| 5,060,671 | A | 10/1991 | Counts et al. |
| 5,093,894 | A | 3/1992 | Deevi et al. |
| 5,261,424 | A | 11/1993 | Sprinkel, Jr. |
| 5,388,574 | A | 2/1995 | Ingebrethsen et al. |
| 5,530,225 | A | 6/1996 | Hajaligol |
| 5,665,262 | A | 9/1997 | Hajaligol et al. |
| 5,687,746 | A | 11/1997 | Rose et al. |

(Continued)

FOREIGN PATENT DOCUMENTS

| | | |
|---|---|---|
| CN | 1541577 | 11/2004 |
| CN | 2719043 | 8/2005 |

(Continued)

OTHER PUBLICATIONS

Philip Morris Products S.A .; EA 22838B1—Machine Translation; Mar. 31, 2016.

(Continued)

*Primary Examiner* — James Harvey

(74) *Attorney, Agent, or Firm* — Womble Bond Dickinson (US) LLP

(57) ABSTRACT

An atomizer and an aerosol delivery device are described, where the atomizer has a fluid transport element formed from a rigid monolith having a first side and a second side opposite to the first side. The atomizer also has a heater. The heater provides a substantially planar heating surface. The heating surface is positioned to face the first side of the rigid monolith.

20 Claims, 7 Drawing Sheets

(56) References Cited

U.S. PATENT DOCUMENTS

| | | | | |
|---|---|---|---|---|
| 5,726,421 | A | 3/1998 | Fleischhauer et al. | |
| 5,865,185 | A | 2/1999 | Collins et al. | |
| 5,894,841 | A | 4/1999 | Voges | |
| 6,125,853 | A | 10/2000 | Susa et al. | |
| 6,155,268 | A | 12/2000 | Takeuchi | |
| 7,117,867 | B2 | 10/2006 | Cox et al. | |
| 7,832,410 | B2 | 11/2010 | Hon | |
| 8,314,591 | B2 | 11/2012 | Terry et al. | |
| 8,365,742 | B2 | 2/2013 | Hon | |
| 8,499,766 | B1 | 8/2013 | Newton | |
| 9,440,035 | B2 | 9/2016 | Walnut | |
| 10,932,490 | B2 * | 3/2021 | Hejazi | A24F 40/46 |
| 2005/0016550 | A1 | 1/2005 | Katase | |
| 2006/0012057 | A1 | 1/2006 | Anthony | |
| 2006/0196518 | A1 | 9/2006 | Hon | |
| 2008/0092912 | A1 | 4/2008 | Robinson et al. | |
| 2009/0095311 | A1 | 4/2009 | Hon | |
| 2009/0126745 | A1 | 5/2009 | Hon | |
| 2009/0188490 | A1 | 7/2009 | Hon | |
| 2009/0272379 | A1 | 11/2009 | Thorens et al. | |
| 2011/0094523 | A1 | 4/2011 | Thorens et al. | |
| 2011/0126848 | A1 | 6/2011 | Zuber et al. | |
| 2011/0155718 | A1 | 6/2011 | Greim et al. | |
| 2011/0168194 | A1 | 7/2011 | Hon | |
| 2011/0265806 | A1 | 11/2011 | Alarcon et al. | |
| 2011/0277757 | A1 | 11/2011 | Terry et al. | |
| 2011/0290248 | A1 | 12/2011 | Schennum | |
| 2012/0111347 | A1 | 5/2012 | Hon | |
| 2012/0260927 | A1 | 10/2012 | Liu | |
| 2012/0279512 | A1 | 11/2012 | Hon | |
| 2013/0037041 | A1 | 2/2013 | Worm et al. | |
| 2013/0056013 | A1 | 3/2013 | Terry et al. | |
| 2013/0306084 | A1 | 11/2013 | Flick | |
| 2014/0000638 | A1 | 1/2014 | Sebastian et al. | |
| 2014/0060554 | A1 | 3/2014 | Collett et al. | |
| 2014/0060555 | A1 | 3/2014 | Chang et al. | |
| 2014/0096781 | A1 | 4/2014 | Sears et al. | |
| 2014/0096782 | A1 | 4/2014 | Ampolini et al. | |
| 2014/0209105 | A1 | 7/2014 | Sears et al. | |
| 2014/0253144 | A1 | 9/2014 | Novak et al. | |
| 2014/0261408 | A1 | 9/2014 | DePiano et al. | |
| 2014/0261486 | A1 | 9/2014 | Potter et al. | |
| 2014/0261487 | A1 | 9/2014 | Chapman et al. | |
| 2014/0261495 | A1 | 9/2014 | Novak et al. | |
| 2014/0270727 | A1 | 9/2014 | Ampolini et al. | |
| 2014/0270729 | A1 | 9/2014 | DePiano et al. | |
| 2014/0270730 | A1 | 9/2014 | DePiano et al. | |
| 2015/0059780 | A1 | 3/2015 | Davis et al. | |
| 2015/0090256 | A1 | 4/2015 | Chung | |
| 2015/0272218 | A1 | 10/2015 | Chen | |
| 2016/0095356 | A1 | 4/2016 | Chan | |
| 2016/0135506 | A1 | 5/2016 | Sanchez et al. | |
| 2016/0295925 | A1 | 10/2016 | Chen | |
| 2016/0309785 | A1 | 10/2016 | Holtz | |
| 2017/0188626 | A1 | 7/2017 | Davis et al. | |
| 2019/0009039 | A1 * | 1/2019 | Davidson | A61P 25/20 |
| 2019/0053539 | A1 | 2/2019 | Davis et al. | |
| 2019/0350256 | A1 | 11/2019 | Hejazi | |
| 2020/0077703 | A1 | 3/2020 | Monsalud et al. | |
| 2021/0145064 | A1 * | 5/2021 | Hejazi | A24F 40/485 |
| 2022/0168514 | A1 * | 6/2022 | Sebastian | A61M 15/009 |

FOREIGN PATENT DOCUMENTS

| | | | |
|---|---|---|---|
| CN | 201379072 | | 1/2010 |
| CN | 203523810 | U | 4/2014 |
| EA | 22838 | B1 | 3/2016 |
| EP | 0 295 122 | | 12/1988 |
| EP | 0 845 220 | | 6/1998 |
| EP | 1 618 803 | | 1/2006 |
| GB | 2469850 | | 11/2010 |
| JP | 2016/528912 | A | 9/2016 |
| RU | 2613785 | C2 | 3/2017 |
| WO | WO 2003/034847 | | 5/2003 |
| WO | WO 2004/080216 | | 9/2004 |
| WO | WO 2005/099494 | | 10/2005 |
| WO | WO 2007/131449 | | 11/2007 |
| WO | WO 2015/031336 | | 3/2015 |
| WO | WO 2015/031336 | A1 | 3/2015 |
| WO | WO 2017/118927 | A | 7/2017 |

OTHER PUBLICATIONS

JP Notice of Grant dated Nov. 7, 2023 from related JP Application No. 2020-564212 filed May 15, 2019; (with Engl transl); 4 pages.

* cited by examiner

ATOMIZER AND AEROSOL DELIVERY DEVICE

CROSS-REFERENCE TO RELATED APPLICATIONS

The present application is a continuation of U.S. patent application Ser. No. 15/980,816, filed May 16, 2018, which is incorporated by reference herein in its entirety.

FIELD OF THE DISCLOSURE

The present disclosure relates to aerosol delivery devices such as smoking articles, and more particularly to aerosol delivery devices that may utilize electrically generated heat, through conduction or induction, for the production of aerosol (e.g., smoking articles commonly referred to as electronic cigarettes). The smoking articles may be configured to heat an aerosol precursor, which may incorporate materials that may be made or derived from tobacco or otherwise incorporate tobacco, the precursor being capable of forming an inhalable substance for human consumption.

BACKGROUND

Many smoking devices have been proposed through the years as improvements upon, or alternatives to, smoking products that require combusting tobacco for use. Many of those devices purportedly have been designed to provide the sensations associated with cigarette, cigar, or pipe smoking, but without delivering considerable quantities of incomplete combustion and pyrolysis products that result from the burning of tobacco. To this end, there have been proposed numerous smoking products, flavor generators, and medicinal inhalers that utilize electrical energy to vaporize or heat a volatile material, or attempt to provide the sensations of cigarette, cigar, or pipe smoking without burning tobacco to a significant degree. See, for example, the various alternative smoking articles, aerosol delivery devices, and heat generating sources set forth in the background art described in U.S. Pat. No. 7,726,320 to Robinson et al., U.S. Pat. Pub. No. 2013/0255702 to Griffith Jr. et al., and U.S. Pat. Pub. No. 2014/0096781 to Sears et al., which are incorporated herein by reference. See also, for example, the various types of smoking articles, aerosol delivery devices, and electrically powered heat generating sources referenced by brand name and commercial source in U.S. patent application Ser. No. 14/170,838 to Bless et al., filed Feb. 3, 2014, which is incorporated herein by reference.

It would be desirable to provide a vapor-forming unit of an aerosol delivery device, the vapor-forming unit being configured for improved vapor formation. It would also be desirable to provide aerosol delivery devices that are prepared utilizing such vapor-forming units.

SUMMARY OF THE DISCLOSURE

The present disclosure relates to aerosol delivery devices and elements of such devices. The aerosol delivery devices can particularly integrate wicks to form vapor-forming units that can be combined with power units to form the aerosol delivery devices.

In one or more embodiments, the present disclosure can relate to an atomizer that is particularly useful in an aerosol delivery device. The atomizer particularly can include at least a fluid transport element and a heater. The fluid transport element can be formed of a rigid material, for example a porous or non-porous monolith. The combined heater and fluid transport element can exhibit improved vapor formation in light of certain configurations of the individual components and materials.

In some embodiments, an example atomizer can comprise a fluid transport element comprising a rigid monolith, the rigid monolith having a first side and a second side opposite to the first side, and a heater, wherein the heater comprises a substantially planar heating surface, and wherein the heating surface is positioned to face the first side of the rigid monolith.

In some embodiments, the rigid monolith is formed from a porous material capable of wicking an aerosol precursor composition into proximity of the heating surface through capillary action.

In some embodiments, the rigid monolith is formed from a substantially nonporous material, and wherein the rigid monolith includes at least one aperture passing from the first side to the second side for providing a conduit for vaporized aerosol precursor.

In certain embodiments, the fluid transfer element further comprises an absorptive pad along the first side of the rigid monolith.

In example embodiments, the rigid monolith further comprises at least one passage proximate the periphery thereof for providing a conduit for liquid aerosol precursor to travel from the second side to the first side of the rigid monolith.

In some embodiments, the rigid monolith has a recess formed in the first side, and the heating surface is positioned to face a base surface of the recess. According to some implementations, the rigid monolith comprises at least one aperture extending from the base surface to the second side. The at least one aperture may comprise a centrally located aperture. The at least one aperture may comprise a plurality of apertures, and the centrally located aperture can have a larger diameter than the remainder of the plurality of apertures. In some instances, the base surface comprises a boss through which the centrally located aperture passes. In some embodiments, the recess of the rigid monolith has a depth greater than about 30% of a thickness of the disk. Where an absorptive pad and a recess are provided, the pad may reside in the recess. In some embodiments, the absorptive pad may comprise a centrally located aperture.

In some embodiments, the heater comprises at least one heating element selected from the group comprising a heater wire, a conductive mesh, and a conductive trace printed on a surface of a substrate, or heater covered by thermally conductive materials.

In some embodiments, the atomizer also includes a thermal insulator separate from the heater, where the insulator may be a mica disk or other materials with low thermal conductivity.

In certain aspects of the present disclosure the atomizer as described herein be included for use in an aerosol delivery device.

In some embodiments, the aerosol delivery device defines an air flow path from an air intake opening to a mouthpiece that passes along the second side of the rigid monolith.

In some embodiments, the rigid monolith comprises at least one aperture extending from the first side to the second side, wherein the aerosol delivery device is configured such that vaporized aerosol precursor is pulled through the at least one aperture by gravity force or by a pressure differential created by a draw of air moving along the air flow path along the second side of the rigid monolith.

In some embodiments, the aerosol delivery device includes a reservoir (e.g., a tank) including an aerosol precursor composition. The reservoir may be tubular or another shape such as rectangular, and the aerosol delivery device may create an air flow path from an air intake opening to a mouthpiece that passes through the reservoir.

In some embodiments, the rigid monolith further comprises circumferential grooves formed in the second side thereof, the grooves configured to help seal the rigid monolith to the reservoir.

The fluid transport element can wick or otherwise transport aerosol precursor composition from the reservoir to the heater that is in thermal connection with the fluid transport element. The heater is positioned exterior to the reservoir so as to vaporize at least a portion of the aerosol precursor composition that is transported from the reservoir via the fluid transport element. The formed vapor can combine with air that is drawn into the aerosol delivery device to form an aerosol that flows to a mouthend of the aerosol delivery device and exits the aerosol delivery device. The aerosol delivery device including the atomizer can be a single, unitary structure housing all elements as described herein useful for forming an aerosol (e.g., power, control, and vaporization elements). The aerosol delivery device can be a cartridge or tank that attaches to a separate control body, where the control body may include a power element (e.g., a battery) and/or a control element.

BRIEF DESCRIPTION OF THE FIGURES

Figure 1:
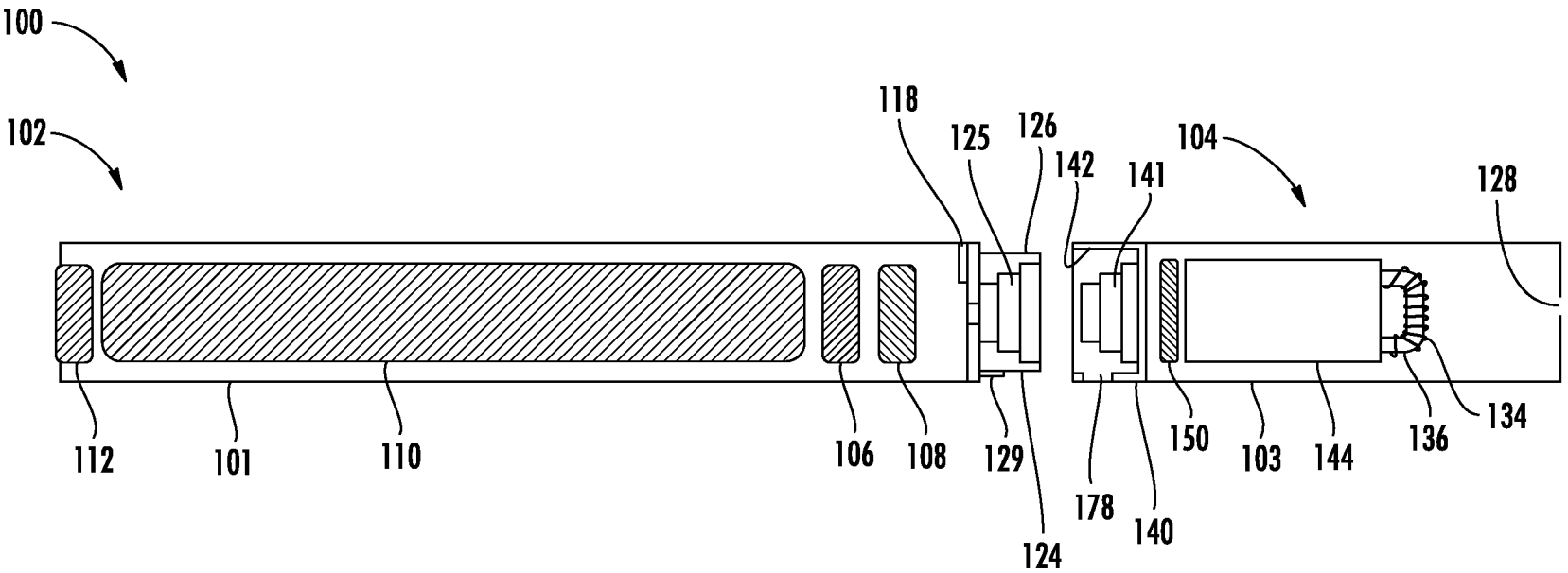
Figure 2:
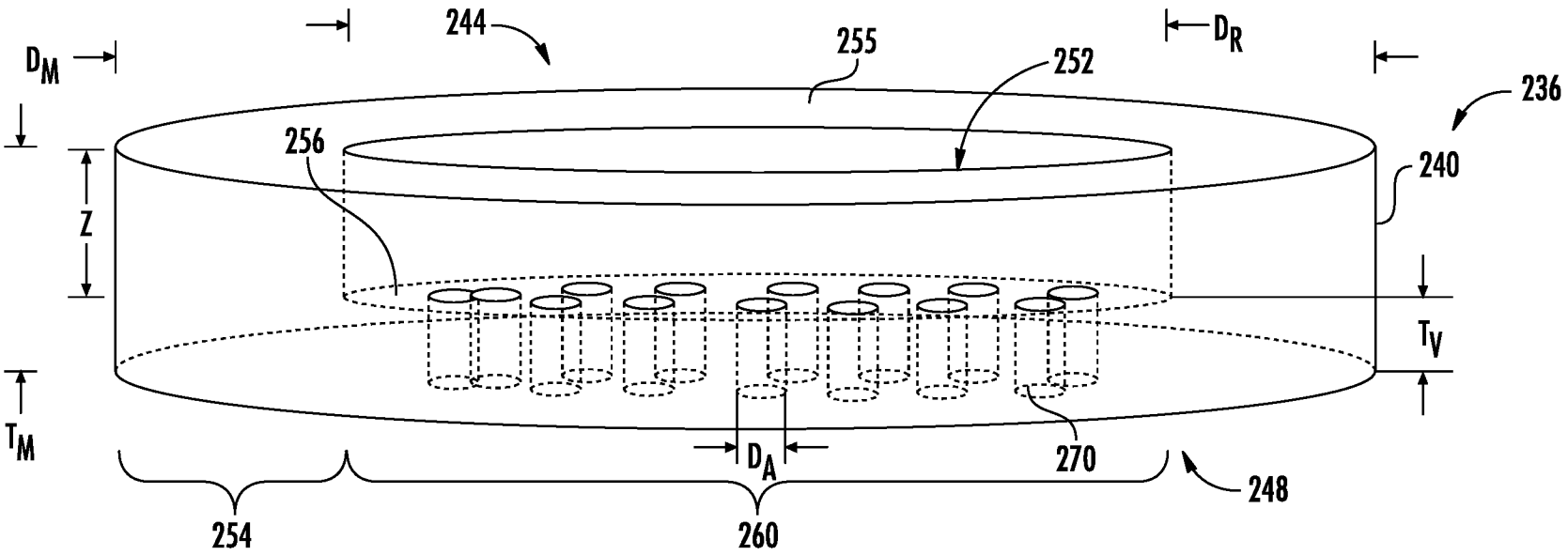
Figure 3:
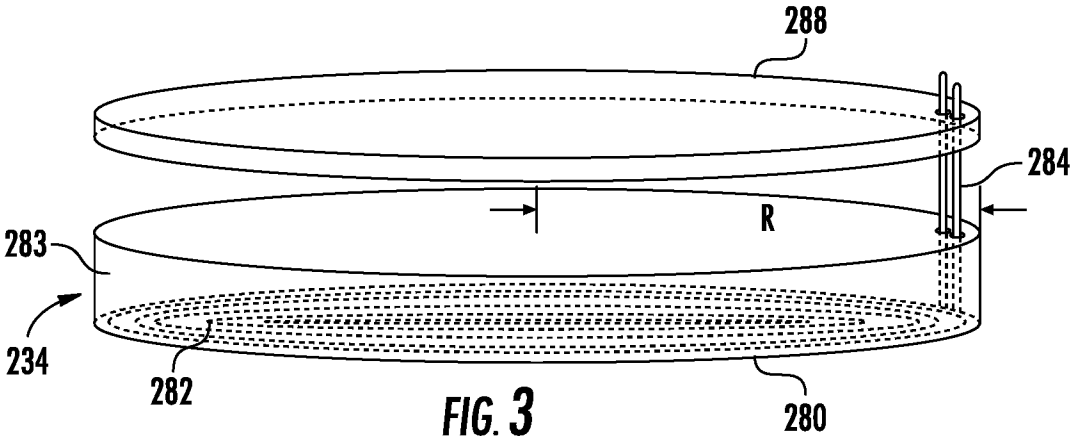
Figure 4:
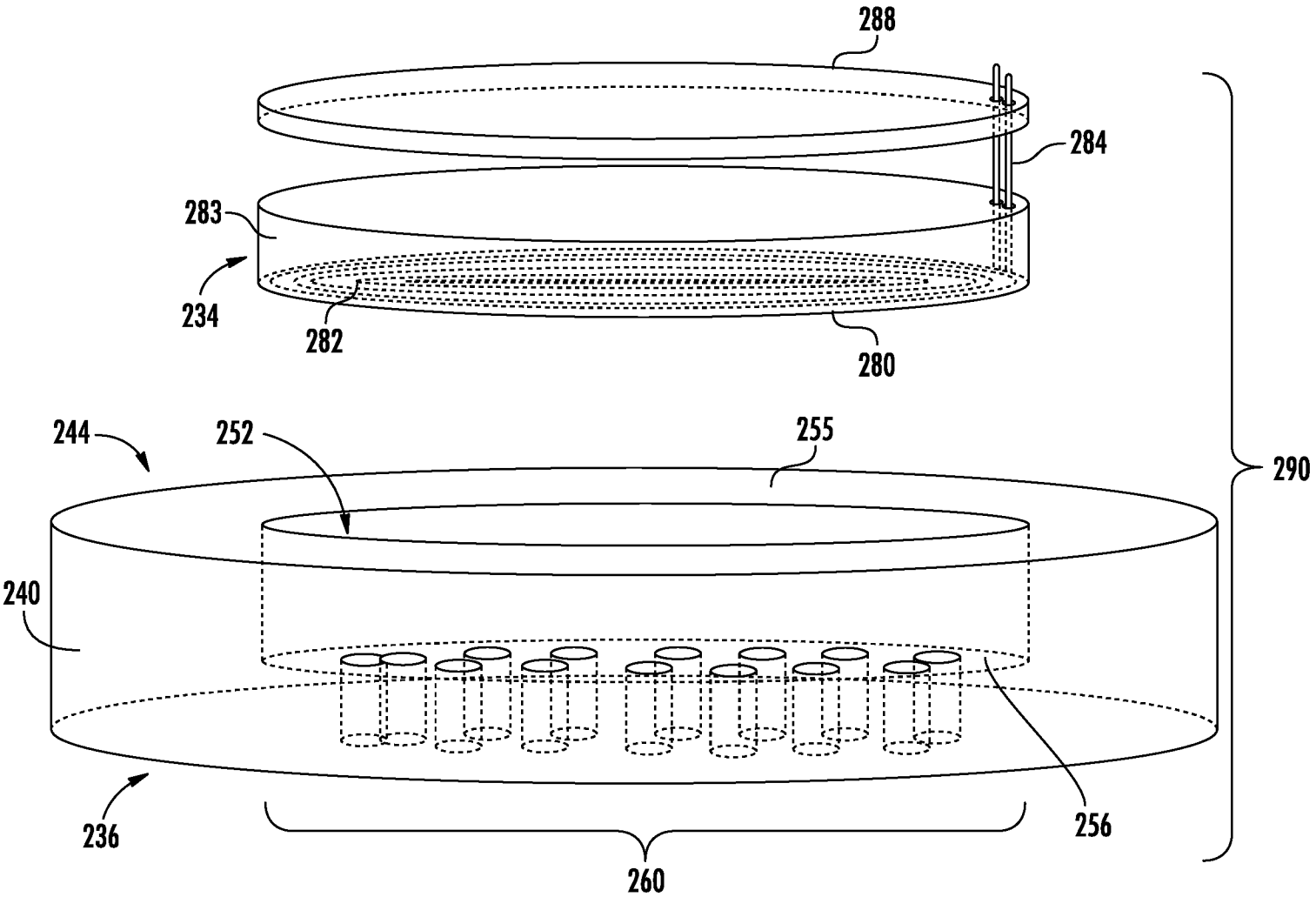
Figure 5:
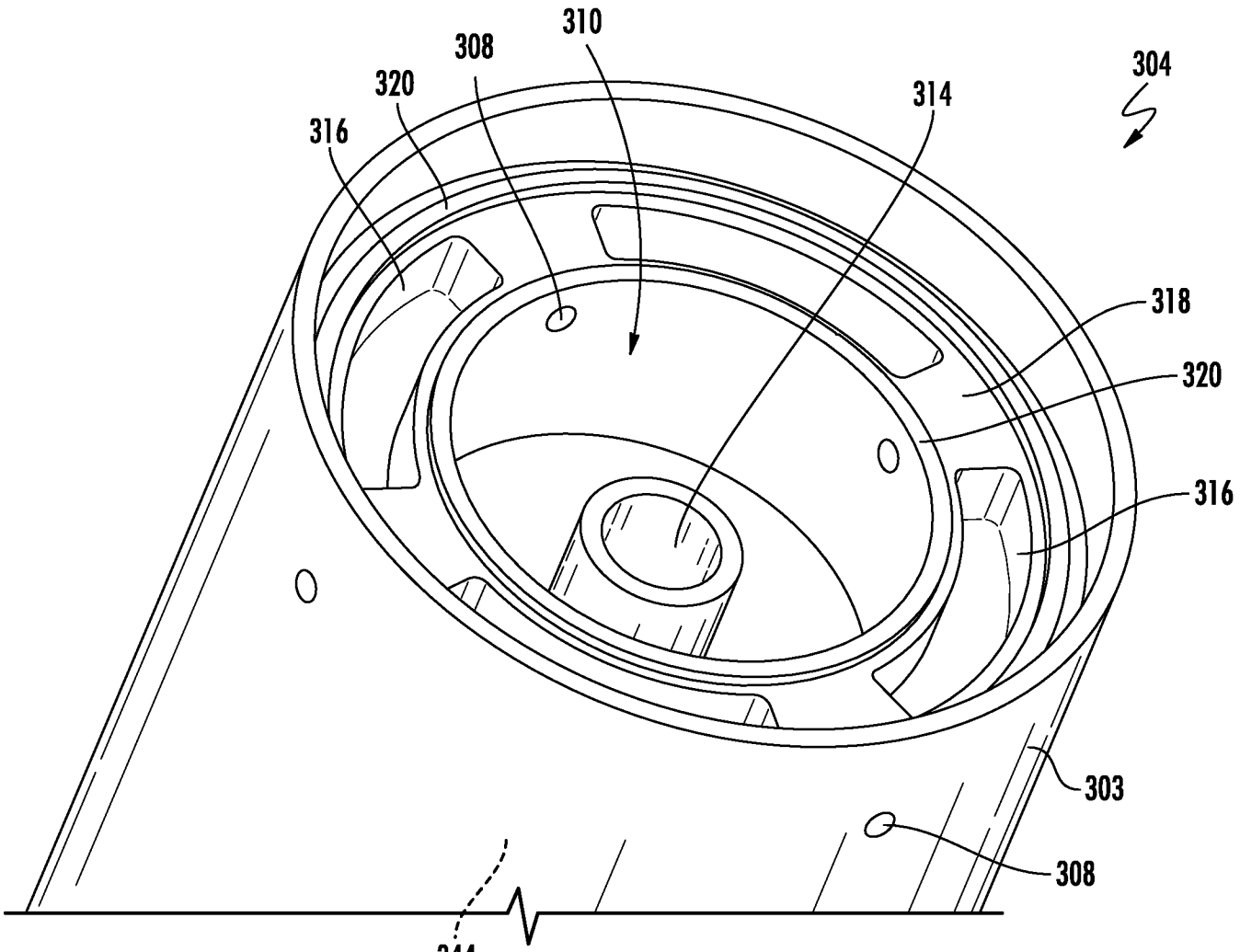
Figure 6:
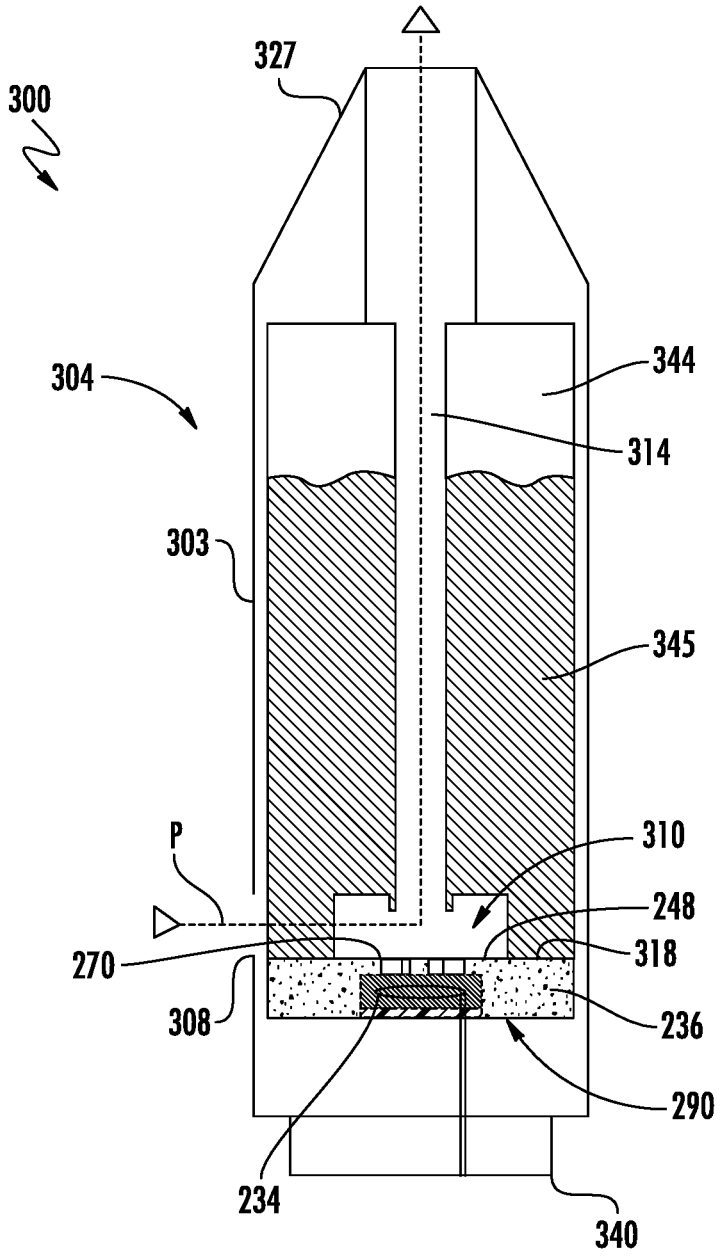
Figure 7:
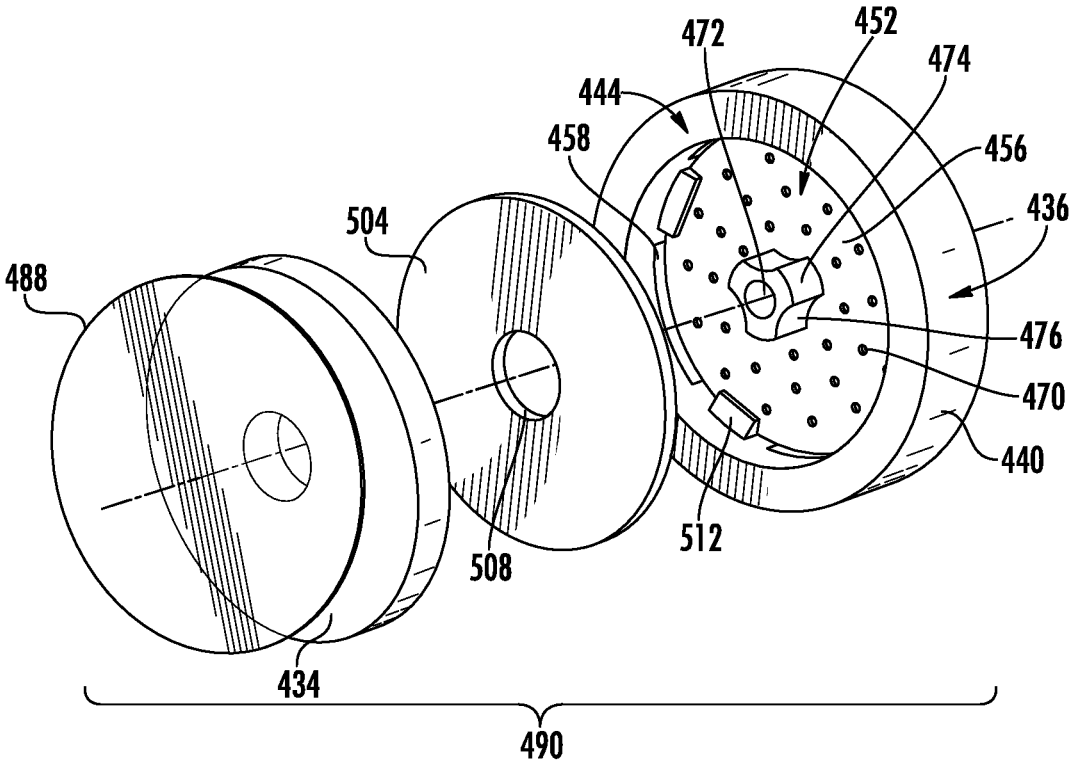
Figure 8:
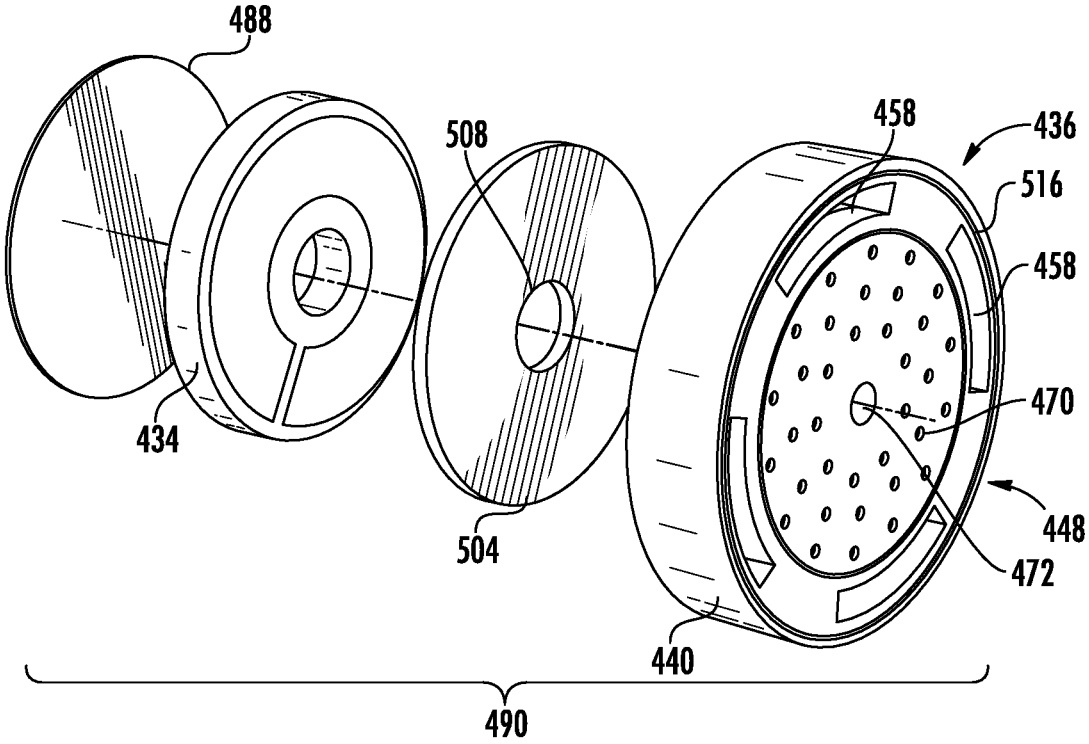

Having thus described the disclosure in the foregoing general terms, reference will now be made to the accompanying drawings, which are not necessarily drawn to scale, and wherein:

FIG. 1 is a partially cut-away view of an aerosol delivery device comprising a cartridge and a power unit including a variety of elements that may be utilized in an aerosol delivery device according to various embodiments of the present disclosure;

FIG. 2 is an illustration of a fluid transport element according to an embodiment of the present disclosure;

FIG. 3 is an illustration of a heater and insulator according to an embodiment of the present disclosure;

FIG. 4 is an exploded illustration of an atomizer according to an embodiment of the present disclosure;

FIG. 5 is an end perspective view of a tank that functions as a reservoir according to an embodiment of the present disclosure;

FIG. 6 is a schematic partially cut-away view of an aerosol delivery device comprising the tank of FIG. 5 and the atomizer of FIG. 4. that includes a reservoir and an atomizer according to an embodiments of the present disclosure;

FIG. 7 is an exploded perspective view from a first side of a heater according to another embodiment of the present disclosure;

FIG. 8 is an exploded perspective view from a second side of the heater of FIG. 7.

Figure 9:
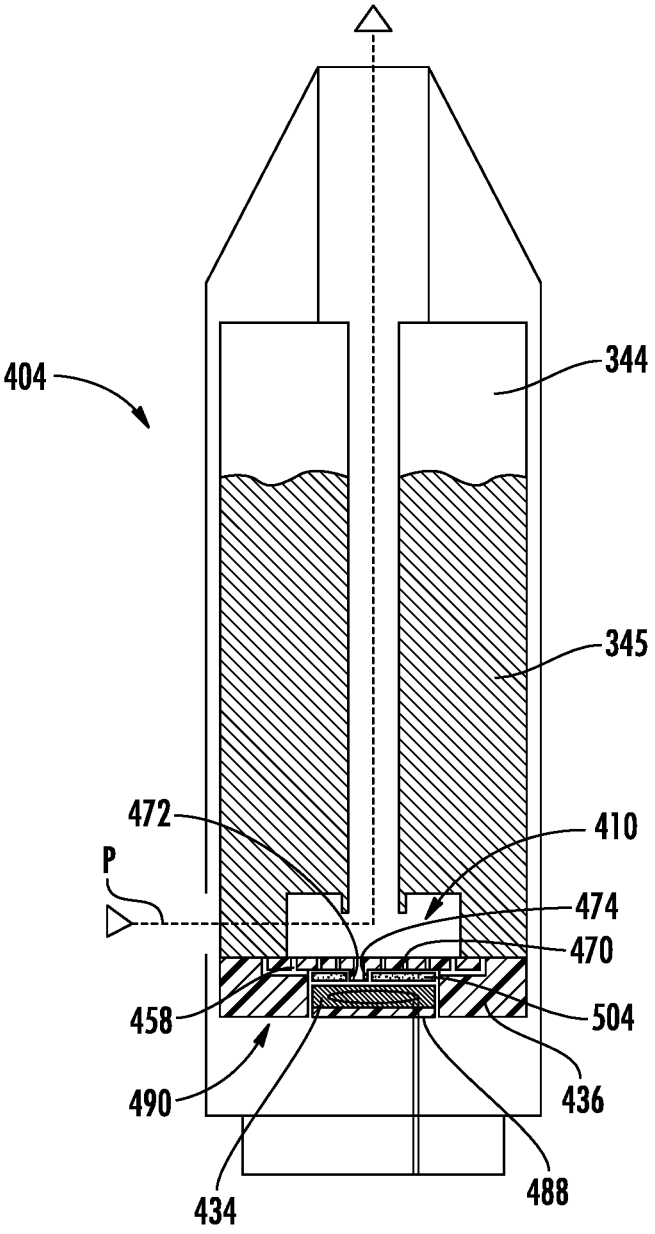

FIG. 9 is a schematic partially cut-away view of an aerosol delivery device comprising the tank of FIG. 5 and the atomizer of FIGS. 7 and 8.

DETAILED DESCRIPTION

The present disclosure will now be described more fully hereinafter with reference to example embodiments thereof. These example embodiments are described so that this disclosure will be thorough and complete, and will fully convey the scope of the disclosure to those skilled in the art. Indeed, the disclosure may be embodied in many different forms and should not be construed as limited to the embodiments set forth herein; rather, these embodiments are provided so that this disclosure will satisfy applicable legal requirements. As used in the specification, and in the appended claims, the singular forms "a", "an", "the", include plural referents unless the context clearly dictates otherwise.

As described hereinafter, embodiments of the present disclosure relate to aerosol delivery systems. Aerosol delivery systems according to the present disclosure use electrical energy to heat a material (for example, without combusting the material to any significant degree and/or without significant chemical alteration of the material) to form an inhalable substance; and components of such systems have the form of articles that can be sufficiently compact to be considered hand-held devices. That is, use of components of aerosol delivery systems does not result in the production of smoke—i.e., from by-products of combustion or pyrolysis of tobacco, but rather, use of those systems results in the production of vapors resulting from volatilization or vaporization of certain components incorporated therein. In some embodiments, components of aerosol delivery systems may be characterized as electronic cigarettes, and those electronic cigarettes can incorporate tobacco and/or components derived from tobacco, and hence deliver tobacco derived components in aerosol form.

Aerosol generating pieces of certain aerosol delivery systems may provide many of the sensations (e.g., inhalation and exhalation rituals, types of tastes or flavors, organoleptic effects, physical feel, use rituals, visual cues such as those provided by visible aerosol, and the like) of smoking a cigarette, cigar, or pipe that is employed by lighting and burning tobacco (and hence inhaling tobacco smoke), without any substantial degree of combustion of any component thereof. For example, the user of an aerosol generating piece of the present disclosure can hold and use that piece much like a smoker employs a traditional type of smoking article, draw on one end of that piece for inhalation of aerosol produced by that piece, take or draw puffs at selected intervals of time, and the like.

Aerosol delivery devices of the present disclosure also can be characterized as being vapor-producing articles or medicament delivery articles. Thus, such articles or devices can be adapted so as to provide one or more substances (e.g., flavors and/or pharmaceutical active ingredients) in an inhalable form or state. For example, inhalable substances can be substantially in the form of a vapor (i.e., a substance that is in the gas phase at a temperature lower than its critical point). Alternatively, inhalable substances can be in the form of an aerosol (i.e., a suspension of fine solid particles or liquid droplets in a gas). For purposes of simplicity, the term "aerosol" as used herein is meant to include vapors, gases, and aerosols of a form or type suitable for human inhalation, whether or not visible, and whether or not of a form that might be considered to be smoke-like.

Aerosol delivery devices of the present disclosure generally include a number of components provided within an outer body or shell, which may be referred to as a housing. The overall design of the outer body or shell can vary, and the format or configuration of the outer body that can define the overall size and shape of the aerosol delivery device can vary. Typically, an elongated body resembling the shape of a cigarette or cigar can be a formed from a single, unitary housing, or the elongated housing can be formed of two or more separable bodies. For example, an aerosol delivery device can comprise an elongated shell or body that can be substantially tubular in shape and, as such, resemble the shape of a conventional cigarette or cigar. In another embodiment, the shell may have a rectangular, triangular, oval or other cross sectional shape. In one embodiment, all of the components of the aerosol delivery device are contained within one housing. Alternatively, an aerosol delivery device can comprise two or more housings that are joined and are separable. For example, an aerosol delivery device can possess at one end a control body (or power unit) comprising a housing containing one or more components (e.g., a battery and various electronics for controlling the operation of that article), and at the other end and removably attached thereto an outer body or shell containing aerosol forming components (e.g., one or more aerosol precursor components, such as flavors and aerosol formers, one or more heaters, and/or one or more wicks).

Aerosol delivery devices of the present disclosure can be formed of an outer housing or shell that is not substantially tubular in shape but may be formed to substantially greater dimensions. The housing or shell can be configured to include a mouthpiece and/or may be configured to receive a separate shell (e.g., a cartridge or tank) that can include consumable elements, such as a liquid aerosol former, and can include a vaporizer or atomizer.

Aerosol delivery devices of the present disclosure often comprise some combination of a power source (i.e., an electrical power source), at least one control component (e.g., means for actuating, controlling, regulating and ceasing power for heat generation, such as by controlling electrical current flow the power source to other components of the article—e.g., a microcontroller or microprocessor), a heater or heat generation member (e.g., an electrical resistance heating element or material configured to generate heat as the result of eddy currents through induction, which alone or in combination with one or more further elements may be commonly referred to as an "atomizer"), an aerosol precursor composition (e.g., commonly a liquid capable of yielding an aerosol upon application of sufficient heat, such as ingredients commonly referred to as "smoke juice," "e-liquid" and "e-juice"), and a mouthpiece or mouth region for allowing draw upon the aerosol delivery device for aerosol inhalation (e.g., a defined airflow path through the article such that aerosol generated can be withdrawn therefrom upon draw).

More specific formats, configurations and arrangements of components within the aerosol delivery systems of the present disclosure will be evident in light of the further disclosure provided hereinafter. Additionally, the selection and arrangement of various aerosol delivery system components can be appreciated upon consideration of the commercially available electronic aerosol delivery devices, such as those representative products referenced in the background art section of the present disclosure.

One example embodiment of an aerosol delivery device 100 illustrating components that may be utilized in an aerosol delivery device according to the present disclosure is provided in FIG. 1. As seen in the cut-away view illustrated therein, the aerosol delivery device 100 can comprise a power unit 102 and a cartridge 104 that can be permanently or detachably aligned in a functioning relationship. Engagement of the power unit 102 and the cartridge 104 can be press fit (as illustrated), threaded, interference fit, magnetic, or the like. In particular, connection components, such as further described herein may be used. For example, the power unit may include a coupler that is adapted to engage a connector on the cartridge. As a further example, in some example embodiments, the housing of the power unit 102 may define a cavity configured to receive at least a portion of the cartridge 104. In such embodiments in which at least a portion of the cartridge 104 is received into a cavity of the power unit 102, the cartridge 104 may be retained in the cavity of the power unit 102 by interference fit (e.g., through use of detents and/or other features creating an interference engagement between an outer surface of the cartridge 104 and an interior surface of a wall of the cavity), magnetic engagement, or other suitable technique.

In specific embodiments, one or both of the power unit 102 and the cartridge 104 may be referred to as being disposable or as being reusable. For example, the power unit may have a replaceable battery or a rechargeable battery and thus may be combined with any type of recharging technology, including connection to a wall charger, connection to a car charger (i.e., cigarette lighter receptacle), and connection to a computer, any of which may include a universal serial bus (USB) cable or connector (e.g., USB 2.0, 3.0, 3.1, USB Type-C), connection to a photovoltaic cell (sometimes referred to as a solar cell) or solar panel of solar cells, or wireless charger, such as a charger that uses inductive wireless charging (including for example, wireless charging according to the Qi wireless charging standard from the Wireless Power Consortium (WPC)), or a wireless radio frequency (RF) based charger. An example of an inductive wireless charging system is described in U.S. Pat. App. Pub. No. 2017/0112196 to Sur et al., which is incorporated herein by reference in its entirety. Further, in some embodiments the cartridge may comprise a single-use cartridge, as disclosed in U.S. Pat. No. 8,910,639 to Chang et al., which is incorporated herein by reference.

As illustrated in FIG. 1, a power unit 102 can be formed of a power unit shell 101 that can include a control component 106 (e.g., a printed circuit board (PCB), an integrated circuit, a memory component, a microcontroller, or the like, as well as a resistance temperature detector for temperature control), a flow sensor 108, a battery 110, and an LED 112, and such components can be variably aligned. Further indicators (e.g., a haptic feedback component, an audio feedback component, or the like) can be included in addition to or as an alternative to the LED. Additional representative types of components that yield visual cues or indicators, such as light emitting diode (LED) components, and the configurations and uses thereof, are described in U.S. Pat. No. 5,154,192 to Sprinkel et al.; U.S. Pat. No. 8,499,766 to Newton and U.S. Pat. No. 8,539,959 to Scatterday; U.S. Pat. Pub. No. 2015/0020825 to Galloway et al.; and U.S. Pat. Pub. No. 2015/0216233 to Sears et al.; which are incorporated herein by reference. It is understood that not all of the illustrated elements are required. For example, an LED may be absent or may be replaced with a different indicator, such as a vibrating indicator. Likewise, a flow sensor may be replaced with a manual actuator, such as a push button.

A cartridge 104 can be formed of a cartridge shell 103 enclosing the reservoir 144 that is in fluid communication with a fluid transport element 136 adapted to wick or otherwise transport an aerosol precursor composition stored in the reservoir housing to a heater 134. A fluid transport element can be formed of one or more materials configured for transport of a liquid, such as by capillary action. A fluid transport element can be formed of, for example, fibrous materials (e.g., organic cotton, cellulose acetate, regenerated cellulose fabrics, glass fibers), porous ceramics (alumina, silica, zirconia, SiC, SiN, AlN, etc.), porous carbon, graphite, porous glass, sintered glass beads, sintered ceramic beads, capillary tubes, porous polymers, or the like. The fluid transport element thus can be any material that contains an open pore network (i.e., a plurality of pores that are interconnected so that fluid may flow from one pore to another in a plurality of direction through the element). The pores can be nanopores, micropores, macropores or combinations thereof. As further discussed herein, some embodiments of the present disclosure can particularly relate to the use of non-fibrous transport elements. As such, in some embodiments, fibrous transport elements can be expressly excluded. Alternatively, combinations of fibrous transport elements and non-fibrous transport elements may be utilized. In some embodiments, the fluid transport element may be a substantially solid non-porous material, such as a polymer or dense ceramic or metals, configured to channel liquid through apertures or slots while not necessarily relying upon wicking through capillary action. Such a solid body may be used in combination with a porous absorptive pad. The absorptive pad can be formed of silica-based fibers, organic cotton, rayon fibers, cellulose acetate, regenerated cellulose fabrics, highly porous ceramic or metal mesh, etc.

Various embodiments of materials configured to produce heat when electrical current is applied therethrough may be employed to form the heater 134. Example materials from which the wire coil may be formed include Kanthal (FeCrAl), nichrome, nickel, stainless steel, indium tin oxide, tungsten, molybdenum disilicide ($MoSi_2$), molybdenum silicide (MoSi), molybdenum disilicide doped with aluminum ($Mo(Si,Al)_2$), titanium, platinum, silver, palladium, alloys of silver and palladium, graphite and graphite-based materials (e.g., carbon-based foams and yarns), conductive inks, boron doped silica, and ceramics (e.g., positive or negative temperature coefficient ceramics). The heater 134 may be resistive heating element or a heating element configured to generate heat through induction. The heater 134 may be coated by heat conductive ceramics such as aluminum nitride, silicon carbide, beryllium oxide, alumina, silicon nitride, or their composites.

An opening 128 may be present in the cartridge shell 103 (e.g., at the mouthend) to allow for egress of formed aerosol from the cartridge 104. Such components are representative of the components that may be present in a cartridge and are not intended to limit the scope of cartridge components that are encompassed by the present disclosure.

The cartridge 104 also may include one or more electronic components 150, which may include an integrated circuit, a memory component, a sensor, or the like. The electronic component 150 may be adapted to communicate with the control component 106 and/or with an external device by wired or wireless means. The electronic component 150 may be positioned anywhere within the cartridge 104 or its base 140.

Although the control component 106 and the flow sensor 108 are illustrated separately, it is understood that the control component and the flow sensor may be combined as an electronic circuit board with the air flow sensor attached directly thereto. The control component 106 may be considered as inclusive of a resistance temperature detector or the resistance temperature detector may be incorporated with the electronic component 150. Further, the electronic circuit board may be positioned horizontally relative the illustration of FIG. 1 in that the electronic circuit board can be lengthwise parallel to the central axis of the power unit. In some embodiments, the air flow sensor may comprise its own circuit board or other base element to which it can be attached. In some embodiments, a flexible circuit board may be utilized. A flexible circuit board may be configured into a variety of shapes, include substantially tubular shapes. Configurations of a printed circuit board and a pressure sensor, for example, are described in U.S. Pat. Pub. No. 2015/0245658 to Worm et al., the disclosure of which is incorporated herein by reference.

The power unit 102 and the cartridge 104 may include components adapted to facilitate a fluid engagement therebetween. As illustrated in FIG. 1, the power unit 102 can include a coupler 124 having a cavity 125 therein. The cartridge 104 can include a base 140 adapted to engage the coupler 124 and can include a projection 141 adapted to fit within the cavity 125. Such engagement can facilitate a stable connection between the power unit 102 and the cartridge 104 as well as establish an electrical connection between the battery 110 and control component 106 in the power unit and the heater 134 in the cartridge. Further, the power unit shell 101 can include an air intake 118, which may be a notch in the shell where it connects to the coupler 124 that allows for passage of ambient air around the coupler and into the shell where it then passes through the cavity 125 of the coupler and into the cartridge through the projection 141. The air intake 118 is not limited being on or adjacent the power unit shell 101, but may be formed through an exterior of the cartridge or some other portion of the aerosol delivery device, such as a detachable mouthpiece.

A coupler and a base useful according to the present disclosure are described in U.S. Pat. Pub. No. 2014/0261495 to Novak et al., the disclosure of which is incorporated herein by reference. For example, a coupler as seen in FIG. 1 may define an outer periphery 126 configured to mate with an inner periphery 142 of the base 140. In one embodiment the inner periphery of the base may define a radius that is substantially equal to, or slightly greater than, a radius of the outer periphery of the coupler. Further, the coupler 124 may define one or more protrusions 129 at the outer periphery 126 configured to engage one or more recesses 178 defined at the inner periphery of the base. However, various other embodiments of structures, shapes, and components may be employed to couple the base to the coupler. In some embodiments the connection between the base 140 of the cartridge 104 and the coupler 124 of the power unit 102 may be substantially permanent, whereas in other embodiments the connection therebetween may be releasable such that, for example, the power unit may be reused with one or more additional cartridges that may be disposable and/or refillable.

The aerosol delivery device 100 may be substantially rod-like or substantially tubular shaped or substantially cylindrically shaped in some embodiments. In other embodiments, further shapes and dimensions are encompassed—e.g., a rectangular, oval, hexagonal, or triangular cross-section, multifaceted shapes, or the like. In particular, the power unit 102 may be non-rod-like and may rather be substantially rectangular, round, or have some further shape. Likewise, the power unit 102 may be substantially larger than a power unit that would be expected to be substantially the size of a conventional cigarette.

The reservoir 144 illustrated in FIG. 1 can be a container (e.g., formed of walls substantially impermeable to the aerosol precursor composition) or can be a fibrous reservoir. Container walls can be flexible and can be collapsible. Container walls alternatively can be substantially rigid. A container may be substantially sealed to prevent passage of aerosol precursor composition therefrom except via any specific opening provided expressly for passage of the aerosol precursor composition, such as through a transport element as otherwise described herein. In example embodiments, the reservoir 144 can comprise one or more layers of nonwoven fibers substantially formed into the shape of a tube encircling the interior of the cartridge shell 103. The fibers can be composed of polycarbonate, silicone, polyester, polyethylene, polypropylene or ceramic. An aerosol precursor composition can be retained in the reservoir 144. Liquid components, for example, can be sorptively retained by the reservoir 144 (i.e., when the reservoir 144 includes a fibrous material). The reservoir 144 can be in fluid connection with a fluid transport element 136. The fluid transport element 136 can transport the aerosol precursor composition stored in the reservoir 144 via capillary action to the heating element 134 that is in the form of a metal wire coil in this embodiment. As such, the heating element 134 is in a heating arrangement with the fluid transport element 136.

In use, when a user draws on the article 100, airflow is detected by the sensor 108, the heating element 134 is activated, and the components for the aerosol precursor composition are vaporized by the heating element 134. Drawing upon the mouthend of the article 100 causes ambient air to enter the air intake 118 and pass through the cavity 125 in the coupler 124 and the central opening in the projection 141 of the base 140. In the cartridge 104, the drawn air combines with the formed vapor to form an aerosol. The aerosol is whisked, aspirated, or otherwise drawn away from the heating element 134 and out the mouth opening 128 in the mouthend of the article 100. Alternatively, in the absence of an airflow sensor, the heating element 134 may be activated manually, such as by a push button.

An input element may be included with the aerosol delivery device (and may replace or supplement an airflow or pressure sensor). The input may be included to allow a user to control functions of the device and/or for output of information to a user. Any component or combination of components may be utilized as an input for controlling the function of the device. For example, one or more pushbuttons may be used as described in U.S. Pub. No. 2015/0245658 to Worm et al., which is incorporated herein by reference. Likewise, a touchscreen may be used as described in U.S. patent application Ser. No. 14/643,626, filed Mar. 10, 2015, to Sears et al., which is incorporated herein by reference. As a further example, components adapted for gesture recognition based on specified movements of the aerosol delivery device may be used as an input. See U.S. Pub. 2016/0158782 to Henry et al., which is incorporated herein by reference. As still a further example, a capacitive sensor may be implemented on the aerosol delivery device to enable a user to provide input, such as by touching a surface of the device on which the capacitive sensor is implemented.

In some embodiments, an input may comprise a computer or computing device, such as a smartphone or tablet. In particular, the aerosol delivery device may be wired to the computer or other device, such as via use of a USB cord or similar protocol. The aerosol delivery device also may communicate with a computer or other device acting as an input via wireless communication. See, for example, the systems and methods for controlling a device via a read request as described in U.S. Pub. No. 2016/0007561 to Ampolini et al., the disclosure of which is incorporated herein by reference. In such embodiments, an APP or other computer program may be used in connection with a computer or other computing device to input control instructions to the aerosol delivery device, such control instructions including, for example, the ability to form an aerosol of specific composition by choosing the nicotine content and/or content of further flavors to be included.

The various components of an aerosol delivery device according to the present disclosure can be chosen from components described in the art and commercially available. Examples of batteries that can be used according to the disclosure are described in U.S. Pat. Pub. No. 2010/0028766 to Peckerar et al., the disclosure of which is incorporated herein by reference.

The aerosol delivery device can incorporate a sensor or detector for control of supply of electric power to the heat generation element when aerosol generation is desired (e.g., upon draw during use). As such, for example, there is provided a manner or method for turning off the power supply to the heat generation element when the aerosol delivery device is not be drawn upon during use, and for turning on the power supply to actuate or trigger the generation of heat by the heat generation element during draw. Additional representative types of sensing or detection mechanisms, structure and configuration thereof, components thereof, and general methods of operation thereof, are described in U.S. Pat. No. 5,261,424 to Sprinkel, Jr.; U.S. Pat. No. 5,372,148 to McCafferty et al.; and PCT WO 2010/003480 to Flick; which are incorporated herein by reference.

The aerosol delivery device may incorporate a control mechanism for controlling the amount of electric power to the heat generation element during draw. Representative types of electronic components, structure and configuration thereof, features thereof, and general methods of operation thereof, are described in U.S. Pat. No. 4,735,217 to Gerth et al.; U.S. Pat. No. 4,947,874 to Brooks et al.; U.S. Pat. No. 5,372,148 to McCafferty et al.; U.S. Pat. No. 6,040,560 to Fleischhauer et al.; U.S. Pat. No. 7,040,314 to Nguyen et al. and U.S. Pat. No. 8,205,622 to Pan; U.S. Pat. Pub. Nos. 2009/0230117 to Fernando et al., 2014/0060554 to Collet et al., and 2014/0270727 to Ampolini et al.; and U.S. Pub. No. 2015/0257445 to Henry et al.; which are incorporated herein by reference.

Representative types of substrates, reservoirs or other components for supporting the aerosol precursor are described in U.S. Pat. No. 8,528,569 to Newton; U.S. Pat. Pub. Nos. 2014/0261487 to Chapman et al. and 2014/0059780 to Davis et al.; and U.S. Pub. No. 2015/0216232 to Bless et al.; which are incorporated herein by reference. Additionally, various wicking materials, and the configuration and operation of those wicking materials within certain types of electronic cigarettes, are set forth in U.S. Pat. No. 8,910,640 to Sears et al.; which is incorporated herein by reference.

For aerosol delivery systems that are characterized as electronic cigarettes, the aerosol precursor composition may incorporate tobacco or components derived from tobacco. In one regard, the tobacco may be provided as parts or pieces of tobacco, such as finely ground, milled or powdered tobacco lamina. Tobacco beads, pellets, or other solid forms may be included, such as described in U.S. Pat. Pub. No. 2015/0335070 to Sears et al., the disclosure of which is incorporated herein by reference. In another regard, the tobacco may be provided in the form of an extract, such as a spray dried extract that incorporates many of the water soluble components of tobacco. Alternatively, tobacco extracts may have the form of relatively high nicotine content extracts, which extracts also incorporate minor amounts of other extracted components derived from tobacco. In another regard, components derived from tobacco may be provided in a relatively pure form, such as certain flavoring agents that are derived from tobacco. In one regard, a component that is derived from tobacco, and that may be employed in a highly purified or essentially pure form, is nicotine (e.g., pharmaceutical grade nicotine). In other embodiments, non-tobacco materials alone may form the aerosol precursor composition.

The aerosol precursor composition, also referred to as a vapor precursor composition, or "e-liquid", may comprise a variety of components including, by way of example, a polyhydric alcohol (e.g., glycerin, propylene glycol, or a mixture thereof), nicotine, tobacco, tobacco extract, and/or flavorants. Representative types of aerosol precursor components and formulations also are set forth and characterized in U.S. Pat. No. 7,217,320 to Robinson et al. and U.S. Pat. Pub. Nos. 2013/0008457 to Zheng et al.; 2013/0213417 to Chong et al.; 2014/0060554 to Collett et al.; 2015/0020823 to Lipowicz et al.; and 2015/0020830 to Koller, as well as WO 2014/182736 to Bowen et al, the disclosures of which are incorporated herein by reference. Other aerosol precursors that may be employed include the aerosol precursors that have been incorporated in VUSE® products by R. J. Reynolds Vapor Company, the BLU™ products by Lorillard Technologies, the MISTIC MENTHOL product by Mistic Ecigs, MARK TEN products by Nu Mark LLC, the JUUL product by Juul Labs, Inc., and VYPE products by CN Creative Ltd. Also desirable are the so-called "smoke juices" for electronic cigarettes that have been available from Johnson Creek Enterprises LLC. Still further example aerosol precursor compositions are sold under the brand names BLACK NOTE, COSMIC FOG, THE MILKMAN E-LIQUID, FIVE PAWNS, THE VAPOR CHEF, VAPE WILD, BOOSTED, THE STEAM FACTORY, MECH SAUCE, CASEY JONES MAINLINE RESERVE, MITTEN VAPORS, DR. CRIMMY'S V-LIQUID, SMILEY E LIQUID, BEANTOWN VAPOR, CUTTWOOD, CYCLOPS VAPOR, SICBOY, GOOD LIFE VAPOR, TELEOS, PINUP VAPORS, SPACE JAM, MT. BAKER VAPOR, and JIMMY THE JUICE MAN. The amount of aerosol precursor that is incorporated within the aerosol delivery system is such that the aerosol generating piece provides acceptable sensory and desirable performance characteristics. For example, it is desired that sufficient amounts of aerosol forming material (e.g., glycerin and/or propylene glycol), be employed in order to provide for the generation of a visible mainstream aerosol that in many regards resembles the appearance of tobacco smoke. The amount of aerosol precursor within the aerosol generating system may be dependent upon factors such as the number of puffs desired per aerosol generating piece. In one or more embodiments, about 0.5 ml or more, about 1 ml or more, about 2 ml or more, about 5 ml or more, or about 10 ml or more of the aerosol precursor composition may be included.

Yet other features, controls or components that can be incorporated into aerosol delivery systems of the present disclosure are described in U.S. Pat. No. 5,967,148 to Harris et al.; U.S. Pat. No. 5,934,289 to Watkins et al.; U.S. Pat. No. 5,954,979 to Counts et al.; U.S. Pat. No. 6,040,560 to Fleischhauer et al.; U.S. Pat. No. 8,365,742 to Hon; U.S. Pat. No. 8,402,976 to Fernando et al.; U.S. Pat. Pub. Nos. 2010/0163063 to Fernando et al.; 2013/0192623 to Tucker et al.; 2013/0298905 to Leven et al.; 2013/0180553 to Kim et al., 2014/0000638 to Sebastian et al., 2014/0261495 to Novak et al., and 2014/0261408 to DePiano et al.; which are incorporated herein by reference.

The foregoing description of use of the article can be applied to the various embodiments described herein through minor modifications, which can be apparent to the person of skill in the art in light of the further disclosure provided herein. The above description of use, however, is not intended to limit the use of the article but is provided to comply with all necessary requirements of disclosure of the present disclosure. Any of the elements shown in the article illustrated in FIG. 1 or as otherwise described above may be included in an aerosol delivery device according to the present disclosure.

In one or more embodiments, the present disclosure particularly can relate to aerosol delivery devices that are configured to provide increased vapor production. Such increase can arise from a variety of factors. In some embodiments, a fluid transport element can be formed partially or completely from a porous monolith, such as a porous ceramic, a porous glass, porous polymer, or the like. Example monolithic materials suitable for use according to embodiments of the present disclosure are described, for example, in U.S. patent application Ser. No. 14/988,109, filed Jan. 5, 2016, and US Pat. No. 2014/0123989 to LaMothe, the disclosures of which are incorporated herein by reference. In some embodiments, the porous monolith can form a substantially rigid wick. In particular, the transport element can be substantially a single, monolithic material rather than a bundle of individual fibers as known in the art.

The use of a rigid, porous monolith as a fluid transport element may be beneficial for improving uniformity of heating and reducing possible charring of the fluid transport element when non-uniform heating occurs. It can also be desirable to eliminate the presence of fibrous materials in an aerosol delivery device. Despite such benefits, porous monoliths also present certain challenges for successful implementation as a fluid transport element. Such challenges are in part due to the different material properties of porous monoliths (e.g., porous ceramics) compared to fibrous wicks. For example, alumina has both a higher thermal conductivity and a higher heat capacity than silica. These thermal properties cause heat to be drawn away from the aerosol precursor composition at the interface of the wick and the heater, and this can require a higher initial energy output to achieve comparable fluid vaporization. The present disclosure realizes means for overcoming such difficulties.

In some embodiments utilizing a porous monolith, energy requirements for vaporization when using a porous monolith can be reduced, and vaporization response time can be improved by increasing heat flux density (measured in Watts per square meter—$W/m^2$) over the surface of the porous monolith fluid transport element. The present disclosure particularly describes embodiments suitable to provide such increase in heat flux density.

In some embodiments, the present disclosure provides an atomizer configuration wherein a fluid transport element provides a planar heat receiving surface to receive heat from a planar heating surface of a heater. FIG. 2 illustrates a first embodiment of the present disclosure, where a fluid transport element 236 is in the form of a substantially rigid, porous monolith. The fluid transport element 236 has a main body 240 in the shape of a circular disk with a first side 244 and a second side 248. The periphery of the main body 240 may take other shapes besides being circular to correspond with the general cross section of an aerosol delivery device that utilizes the fluid transport element 236. The first and second sides 244, 248 generally correspond with the opposite faces of the circular disk in the illustrated embodiment. The first and second side 244, 248 may be surfaces that are substantially parallel with one another. The circular disk may have an outer diameter DM of between about 6 mm and about 14 mm, though the dimensions of the main body 240 may vary depending upon the dimensions of the components of an associated aerosol delivery device. For example, where the aerosol delivery device resembles a cigarette, as shown in FIG. 1, the outer diameter DM may be selected such that the main body fits within the shell 103 (FIG. 1) when the disk is arranged normal to the longitudinal axis of the aerosol delivery device. The outer diameter DM may be constant as illustrated, or may vary, such as to create a stepped portion or a conical outer surface, to facilitate assembly of the aerosol delivery device, including but not limited to facilitating operable fluid contact between a reservoir that contains an aerosol precursor composition and a radially outer portion of the main body 240.

In the illustrated embodiment of FIG. 2, the first side 244 may be a heat receiving side intended to be adjacent to, and optionally in contact with, a heater. The second side 248 may be an aerosol releasing side from which vapor is intended to be whisked from the fluid transfer element 236 by the flow of air generated by a user while drawing upon the mouthend of an aerosol delivery device. In other embodiments, not shown, heat may be applied to the second side 248, aerosol may be whisked from the first side 244, or both heating and whisking may primarily occur relative to a single side of the main body 240. Both heating and whisking at each side of the main body 240 is contemplated in some embodiments, particularly in embodiments where air flow would pass adjacent to each side of the main body.

In the illustrated embodiment of FIG. 2, the first side 244 may include a recess 252 formed or otherwise provided within the main body 240. The recess 252 may have a shape that matches the shape of the periphery of the main body 240. In the case of the circular shape illustrated, the recess 252 may have a diameter DR of between about 5 mm and about 12 mm, generally greater than half of the diameter DM of the main body 240. The diameter DR may be selected in part based upon the radius of a conduit through the reservoir at a location adjacent to the fluid transport element 236.

The portion of the main body 240 between the outer periphery and the recess 252 may be referred to as an absorbing region 254, which may be placed, in whole or in part, in contact with the reservoir as shown in FIG. 6.

The recess 252 may have a depth Z, where Z is between about 1 mm and about 4 mm, and possibly between about 1.75 mm and about 2 mm, which may be approximately one-third to approximately three-quarters of the thickness $T_M$ of the main body 240. Again, the absolute depth and the relative depth of the recess 252 may vary. In one embodiment, the depth Z may be large enough such that a heater and an insulator (e.g., a thermal insulator) may be substantially fully received within the recess 252. In another embodiment, the recess 252 accepts the heater, and the insulator can be placed on a top surface 255 of the main body 240.

The recess 252 defines a base surface 256, which may be referred to as the heat receiving surface. In some embodiments, a recess may be omitted, and the top surface 255 may be the heat receiving surface. The main body 240 has a vapor forming region 260 defined between the base surface 256 of the recess 252 and the second side 248. The vapor forming region 260 may have a thickness $T_V$ of approximately 0.5 mm to approximately 2.5 mm. In one embodiment, $T_V$ is about 1 mm. The area of the base surface 256, as determined by the diameter DR of the recess 252, and the thickness $T_V$ of the vapor forming region 260 may be selected to optimize heat flux density and optimize the ratio of surface area from which aerosol precursor can be released in relation to the volume of the vapor forming region in which aerosol precursor can be staged.

As shown in FIG. 2, one or more apertures 270 may be provided in the vapor forming region 260 that extend from the base surface 256 to the second side 248 of the main body 240. The diameter of the apertures $D_A$ may range from about 0.1 mm to about 0.9 mm, and may be approximately 0.35 mm, though other sizes are also contemplated. The apertures 270 are provided in the porous main body 240 to increase an exposed surface area from which the aerosol precursor may be released into a vapor. In addition to selecting the size of each aperture 270, the quantity and arrangement of the apertures may be varied to optimize the efficient release of aerosol. The efficiency of aerosol release may be determined based upon factors such as the power required to heat the fluid transport element 236 versus the volume of aerosol precursor being vaporized. The apertures 270 may all be approximately equal in size, or their sizes may vary. For example, smaller apertures may be positioned near the center of the vapor forming region 260 with larger apertures located near the periphery of the vapor forming region, or vice versa. The apertures 270 may be arranged randomly or in various ordered arrays, such as a square grid, concentric circles, or having the apertures aligned along radial lines of the circular base surface 256.

The spacing of the apertures 270 may vary as well. Closely spaced apertures 270 may be separated by a thickness of $0.5*D_A$ or less, while widely spaced apertures may be a distance of about $D_A$ or even further apart. The cumulative surface area of the ends of the apertures 270 relative to the total area of the base surface 256 may also vary from approximately 90% open area to about 10% open area or less, ignoring the porosity of the main body 240 itself. For example, in some embodiments, there may be no apertures 270 at all, in which case the percentage of open area would be defined as zero. The use of apertures 270 may facilitate heat transfer from the heater through convection and conduction, either to provide a more uniform heating of the fluid transport element 236 or, alternatively, to help avoid overheating of the heater or the fluid transport element. Where the apertures 270 are used to increase surface area, alternative surface imperfections may be provided at the vapor forming region 260 of the second side 248, such as pockets, cavities, grooves, ribs, projections, protrusions, or the like, to similarly increase the surface area exposed to the second side 248 of the main body 240.

A heater 234 is shown in FIG. 3, and the heater is configured to present a substantially planar heating surface 280 configured to face and be in close proximity to the heat receiving surface (e.g. the base surface 256, or an absorptive pad, if present) of the fluid transfer element 236. In one embodiment a heating wire 282 is arranged substantially along a plane to provide a substantially flat heating element. In one embodiment, the heating element may be sandwiched in between highly thermal conductive materials like ceramics (alumina, zirconia, beryllia, etc.). In one embodiment, the heating wire 282 is formed as a conductive trace printed or otherwise deposited on the face of a flat disk 283 made of ceramic or other heat tolerable materials. The periphery of the heater 234 may be configured to be similar with the shape and diameter of the base surface 256 (FIG. 2) so that the heater 234 may reside substantially within the recess 252 in close proximity or even contacting the base surface in order to transfer heat from the heating surface 280 of the heater 234 to the vapor forming region 260 of the fluid transport element 236. In some embodiments, the radius R of the heater 234 is no greater than half the diameter DR of the recess 252. In one embodiment, the heater 234 may be a stamped heater according to U.S. Pat. No. 9,491,974, which is incorporated herein by reference.

The interior layout of the heating wire 282 within the planar arrangement is not particularly limited with respect to the trace of the heating wire, its number of coils, or the resulting spacing between adjacent portions of the heating wire. Again, the heating wire 282 may be on the heating surface 282 or inset therefrom.

The heater 234 can further include electrical leads 284 to provide positive and negative electrical connections for the heater. The electrical leads 284 can be integrally formed with the heating wire 282 or can be separate elements that can be attached (e.g., by welding or using a connector) to the heating wire. The location of the leads 284 is not particularly limited. The leads 284 may be arranged adjacent to one another or separated from one another.

An exploded view of the fluid transport element 236 and the heater 234 is shown in FIG. 4. An electrical and thermal insulator 288, such as a sheet form of mica or similar insulating materials may also be provided. As understood from FIG. 4, the insulator 288 may be provided on the first side 244 of the main body 240 and be configured to substantially enclose the heater 234 within the recess 252. The electrical leads 284 may be understood to pass through or around the insulator 288 in order to form an electrical connection with the power source. The insulator 288 may be sized and dimensioned to fit with the heater 234 within the recess 252, or the insulator may have a larger diameter and be positioned along the top surface 255 of the main body 240.

The combination of the transport element 226, heater 234, and optional insulator 288 provide an atomizer 290. As understood from FIG. 4, the heater 234 may be configured to reside within the recess 252 of the fluid transport element 236. In this configuration, energy from the heater 234 is focused into the smaller surface area of the vapor forming region 260 of the main body 240.

In one or more alternative embodiments, the heating wire 282 of the heater 234 may be provided in the form of a mesh or screen heater, which can be effective to increase heater surface area coverage over the porous monolithic fluid transport element 236. Again, the heater 234 may be configured for contacting at least a portion of the first side 244, such as the base surface 256, of the fluid transport element, the heater being in the form of a conductive mesh. As used herein, the terms mesh and screen are meant to be interchangeable and to specifically refer to a network of intercrossing, conductive filaments. As such, the conductive mesh can be considered to be network of conductive filaments and/or an interlaced structure. The conductive filaments can be formed of any suitable, electrically conductive material, such as otherwise listed herein for formation of a heater. In one or more embodiments, the conductive filaments can be at least partially interwoven with non-conductive filaments or similar mater.

The heater 234, if formed from a conductive mesh, can define a regular pattern of conductive filaments forming parallelograms or other shapes consistent with a mesh configuration. The conductive filaments particularly can surround insulating spaces. The insulating spaces may be open (e.g., insulated by air) or may be at least partially filled with an insulator. The insulating spaces can be configured to have a defined area so that the heating ability of the heater is increased for a reduced amount of power delivery to the heater. In some embodiments, the insulating spaces can have an average individual area of about 0.01 $\mu m^2$ to about 2 $mm^2$. In further embodiments, the insulating spaces can have an average individual area of about 0.05 $\mu m^2$ to about 1.5 $mm^2$, about 0.1 $\mu m^2$ to about 1 $mm^2$, about 0.25 $\mu m^2$ to about 0.5 $mm^2$, or about 0.5 $\mu m^2$ to about 0.1 $mm^2$. In some embodiments, the insulating spaces can have an average individual area in an upper range, such as about 0.005 $mm^2$ to about 2 $mm^2$, about 0.01 $mm^2$ to about 1.5 $mm^2$, or about 0.02 $mm^2$ to about 1 $mm^2$. In some embodiments, the insulating spaces can have an average individual area in a lower range, such as about 0.01 $\mu m^2$ to about 10 $\mu m^2$, about 0.02 $\mu m^2$ to about 5 $\mu m^2$, or about 0.05 $\mu m^2$ to about 1 $\mu m^2$.

The heating wire 282 or alternatively the conductive mesh is not limited to generating heat through resistance of current directly applied thereto. The heating wire 282 or the conductive mesh may be similarly configured to generate heat through induction and eddy currents in the presence of an alternating magnetic field without direct electrical connection to the power source. For induction heating, other type of materials can be used as heating elements, such as ferritic steel, ferromagnetic ceramics, aluminum, etc.

In further embodiments, an atomizer 290 such as illustrated in FIG. 4 may be included in an aerosol delivery device 300 (FIG. 6), which may include a tank 304. An end perspective view of a tank 304 suitable for combining with the atomizer 290 is shown in FIG. 5. The tank 304 can include an outer body or shell 303 defining a reservoir 344 configured to store liquid aerosol precursor 345 (FIG. 6). The tank 304 can include at least one air intake opening 308. In the illustrated embodiment, the air intake openings 308 are circumferentially spaced and extend radially from the periphery of the tank 304. The air intake openings 308 lead to a chamber 310 either along a shelf 318 or embedded below the top of the shelf 318. In both cases, the end of the tank 304 will be designed to avoid intermixture between the air path and liquid in the reservoir 344. A lumen 314 may extend from the chamber 310 through the tank 304 to a mouthpiece 327 (FIG. 6) for allowing a draw of air to leave the aerosol delivery device 300. One or more holes 316 allow access to the reservoir 344. The holes 316 may be formed in a shelf 318 positioned around the cavity 310. The shelf 318 may include one or more annular rings 320 projecting axially therefrom. The annular rings 320 may be configured to engage mating grooves (516, FIG. 8) to help seal the liquid transport element to the tank 304.

As shown in FIG. 6, the atomizer 290 may be installed onto the shelf 318. Aerosol precursor 345 can exit the reservoir through one or more of the holes 316 (FIG. 5) and be absorbed by the porous fluid transport element 236. Alternatively, as described below, the fluid transport element may be coupled with an absorptive pad between the heater and the fluid transport element for absorbing the aerosol precursor. When the heater 234 is activated, the aerosol precursor composition is vaporized and pulled into the chamber 310 through the apertures 270 or wicked from the second side 248 of the porous fluid transport element 236.

In the illustrated embodiment, air drawn through air intake openings 308 entrains the formed vapor (e.g., in the form of an aerosol wherein the formed vapor is mixed with the air) from the chamber 310, through the lumen 314, to the mouthpiece 327. The air flow path P, illustrated with a stippled line in FIG. 6, from the intake openings 308 to the mouthpiece 327 passes along the second side 248 of the fluid transport element 236. In the illustrated embodiment, the air flow path P does not pass through or around the fluid transport element 236 and does not pass through the apertures 270. Instead, a pressure differential is created in the chamber 310 caused by the draw of air flowing from the air intake openings 308, across the exits of the apertures 270, and out the mouthpiece 327, which pulls the generated aerosols from the apertures 270 and into the chamber 310, where the aerosols are entrained by the flow of air. The pressure differential can also assist with further wicking of aerosol precursor 345 into the fluid transport element 236 from the reservoir 344. As illustrated, the reservoir 344 may be substantially tubular, and the aerosol passes through the reservoir along the air flow path P. The outside shape of the reservoir 344 may match the shape of the shell 303, which is not limited to a cylindrical tube but may include other exterior shapes with a central or other lumen passing therethrough. Other configurations of the elements are also contemplated. The tank 304 may include a connector 340 for connecting the tank to a control body or power unit (e.g., element 102 in FIG. 1). The connector 340 may have a similar structure as the base 140 illustrated in FIG. 1 or may have any further structure suitable for connecting the tank 304 to a control body/power unit. Although not illustrated, it is understood that electrical connections are included to provide an electrical connection between the heater 234 and a battery (e.g., element 110 in FIG. 1) or other power delivery device. Any of the relevant elements from the aerosol delivery device 100 of FIG. 1 may also be included in an aerosol delivery device 300.

The use of at least two, separate heaters can be beneficial to improve vapor production. Specifically, a first heater can be used to pre-heat the liquid for vaporization within the fluid transport element, and a second heater can be used to actually vaporize the liquid. The pre-heating can reduce the total power and/or the absolute temperature and/or the duration of heating required to provide a desired volume of vapor. An external heater, for example, may be a pre-heater, and an internal heater may be a vaporizing heater. Additionally or alternatively, at least two separate heaters may be positioned on an external surface of the fluid transport element. One of the heaters may function as a pre-heater, and the other of the heaters may function as a vaporizing heater. For example, as illustrated in FIG. 6, a pre-heater (not illustrated) may be positioned between heater 234 (which may function as a vaporizing heater) and the reservoir 344. The pre-heater may pre-heat liquid aerosol precursor composition flowing from the reservoir 344 to the vaporizing heater 234 so that the vaporizing heater may achieve vaporization more easily, as described above, and/or the pre-heater may reduce a viscosity of the liquid aerosol precursor composition to improve flow of the liquid from the reservoir to the vaporizing heater. In FIG. 6, the second heater positioned between heater 234 and the reservoir 344 may be a mesh heater as described herein, may be a simple wire coil, or may be any other type of heater useful for providing pre-heating to the liquid in the fluid transport element.

Turning to FIGS. 7 and 8, exploded views of an atomizer 490 according to a second embodiment are illustrated. The atomizer 490 may include an insulator 488, which may be substantially similar to the insulator 288 of the first embodiment. The atomizer 490 may include a heater 434, which may be substantially similar to the heater 234 of the first embodiment discussed above. The atomizer 490 may include a highly absorptive pad 504, which may comprise a fibrous material suitable for absorbing and wicking a liquid aerosol precursor composition. Suitable materials for the pad 504 include silica, ceramic, or cotton. The pad 504 may include an optional central opening 508.

Further, the atomizer 490 includes a fluid transport element 436 according to a second embodiment, where the fluid transport element is a non-porous monolith formed from ceramic, metal, or polymer. The fluid transport element 436 may be configured to transport fluid without reliance upon the porosity thereof. The fluid transport element 436 has a main body 440 with a first side 444 and a second side 448. The thickness between the first side 444 and the second side 448 may be substantially smaller than the other dimensions of the main body 440 such that the main body may be considered substantially flat. In the illustrated embodiment, the main body 440 has a circular shape and therefore may be described as a disk. Other peripheral shapes such as rectangles, hexagons, triangles, other regular and irregular polygonal shapes, ovals, and other shapes are also contemplated.

In the illustrated embodiment of FIG. 7, the first side 444 includes a recess 452 formed or otherwise provided within the main body 440. The recess 452, if present, can define a base surface 456. In other embodiments, the recess may not be present.

One or more passages 458 may be provided near the periphery of the main body 440 that extend between the second side 448 and the first side 444. The passages 458 are configured to provide conduits for the aerosol precursor composition 345 (FIGS. 6 and 9) to flow from the reservoir 344 (FIGS. 6 and 9) to the first, top side 444 of the fluid transport element 436, such as into the recess 452 from the periphery thereof. When the main body 440 is engaged with the tank 404 (FIG. 9), the passages 458 may be understood to be arranged to correspond with the holes 316 (FIG. 5). The number of holes 316 and the number of passages 458 may be selected depending on the required flow rate of the liquid aerosol precursor composition. The edges of the passages 458 on the first side 444 can be tangent to the perimeter of the base surface 456, or can protrude into the base surface.

The aerosol precursor composition 345 may then travel into the space between the base surface 456 and the heater 434, such as being wicked by the absorptive pad 504, or free flowing into said space if the absorptive pad is omitted, such that the aerosol precursor composition may be in direct contact with the heater. When the heater 434 is energized, collected aerosol precursor composition is aerosolized and can exit through the apertures 470 through the fluid transport element 436 into the chamber 410 (FIG. 9) for being entrained in the flow of air along the air flow path P (FIG. 9).

In one embodiment, the apertures 470 may be substantially similar to the apertures 270 described above. Where the porous pad 504 is present, the size range of the apertures 470 may be increased, such as between about 0.1 mm and about 1 mm.

In some embodiments, the apertures 470 include a central aperture 472. The central aperture 472 may be larger than the remainder of the apertures 470. The central apertures may have a size between about 0.5 mm and about 4 mm. In the illustrated embodiment of FIG. 7, the central aperture 472 passes through a raised boss 474 that extends from the base surface 456 of the main body 440. The boss 474 may act to inhibit leakage of liquid aerosol precursor composition from the pad 504 into the central aperture 472. In the illustrated embodiment, the boss 474 includes at least one recess 476 formed in an exterior thereof. The recess 476 can aerosols release from the absorptive pad 504 toward the central aperture 472. In other embodiments, the raised boss 474 may not be present. The raised boss 474 is understood to pass through the central opening 508 of the absorptive pad 504. If the boss 474 is omitted, the central opening 508 may be similarly omitted or remained without any boss.

In one embodiment, the base surface 456 is also formed with standoffs 512 formed around the periphery of the base surface. The standoffs 512 can support the heater 434 and maintain the desired gap between the heater and the base surface 456. The gap receives the aerosol precursor composition. The gap may range in size from about 0.1*Z to about 0.75*Z, where Z (FIG. 2) is the depth of the recess 452. The height of the gap may also correspond to the height reached by the passages 458 above the base surface 456.

In one embodiment, the second side 448 (FIG. 8) of the main body 440 is provided with grooves 516. The grooves 516 may promote contact and fitting between the main body 440 and the tank 404 (FIG. 9) to help create mechanical sealing for preventing liquid aerosol precursor from leaking into the chamber 410. For example, the fit can include engagement between the grooves 516 and the annular rings 320 (FIG. 5) described above.

In one or more instances, values described herein may be characterized with the word "about." It is understood that a value being "about" the stated amount indicates that the stated amount may be exactly the value indicated or may vary from the value indicated by up to 5%, up to 2%, or up to 1%.

Many modifications and other embodiments of the disclosure will come to mind to one skilled in the art to which this disclosure pertains having the benefit of the teachings presented in the foregoing descriptions and the associated drawings. Therefore, it is to be understood that the disclosure is not to be limited to the specific embodiments disclosed herein and that modifications and other embodiments are intended to be included within the scope of the appended claims. Although specific terms are employed herein, they are used in a generic and descriptive sense only and not for purposes of limitation.

The invention claimed is:

1. An aerosol delivery device comprising:

a shell;

an airflow path through the shell;

storage for a liquid aerosol precursor located within the shell;

a monolithic element configured with a first side and a second side opposite the first side and including at least one aperture passing from the first side to the second side for providing a vapor conduit, at least a portion of the monolithic element being in fluid contact with the storage for the liquid aerosol precursor; and a vaporizing element having a substantially planar surface that is arranged relative to the first side of the monolithic element so as to be effective to vaporize liquid aerosol precursor from the storage and form vapor that exits from the at least one aperture through the second side of the monolithic element and into the airflow path.

2. The aerosol delivery device of claim 1, wherein the substantially planar surface is adjacent to or in contact with the first side of the monolithic element.

3. The aerosol delivery device of claim 1, wherein the monolithic element has a recess formed in the first side thereof that defines a base surface in the recess.

4. The aerosol delivery device of claim 3, wherein the substantially planar surface of the vaporizing element is positioned to face the base surface in the recess.

5. The aerosol delivery device of claim 3, wherein the at least one aperture passes from the base surface to the second side.

6. The aerosol delivery device of claim 3, wherein the monolithic element has a thickness defined between the first surface and the second surface, and wherein the recess has a depth that is greater than about 30% of the thickness.

7. The aerosol delivery device of claim 6, wherein depth of the recess is about one-third to about three-quarters of the thickness.

8. The aerosol delivery device of claim 3, further comprising an absorptive pad positioned between the vaporizing element and the first side of the monolithic element.

9. The aerosol delivery device of claim 8, wherein the absorptive pad is positioned in the recess.

10. The aerosol delivery device of claim 3, wherein the vaporizing element is positioned in the recess.

11. The aerosol delivery device of claim 10, further comprising an insulator positioned so that the vaporizing element is between the base surface and the insulator.

12. The aerosol delivery device of claim 1, wherein the vaporizing element comprises a heater.

13. The aerosol delivery device of claim 12, wherein the heater is a mesh heater.

14. The aerosol delivery device of claim 12, wherein the heater is a conductive trace on a substrate surface.

15. The aerosol delivery device of claim 1, wherein the monolithic element comprises at least one conduit through which liquid aerosol precursor passes from the storage to the first side of the monolithic element.

16. The aerosol delivery device of claim 1, wherein the monolithic element is a porous ceramic.

17. The aerosol delivery device of claim 1, wherein the monolithic element is a porous glass.

18. The aerosol delivery device of claim 1, wherein the monolithic element is a porous polymer.

19. The aerosol delivery device of claim 1, wherein the at least one aperture is a plurality of apertures that each have a diameter in the range of about 0.1 mm to about 0.9 mm.

20. The aerosol delivery device of claim 1, further comprising a mouthpiece.

* * * * *